US005601195A

United States Patent [19]

Finola et al.

[11] Patent Number: 5,601,195

[45] Date of Patent: Feb. 11, 1997

[54] BASKET WITH A MOVABLE DIVIDER FOR A DISHWASHER

[75] Inventors: Giancarlo Finola, Pavia; Giuseppe Sergi, Milan, both of Italy

[73] Assignee: Electrolux Zanussi Elettrodomestici S.p.A., Pordenone, Italy

[21] Appl. No.: 413,602

[22] Filed: Mar. 30, 1995

[30] Foreign Application Priority Data

Apr. 1, 1994 [IT] Italy ..... PN940009 U

[51] Int. Cl.[6] ..... A47F 7/00

[52] U.S. Cl. ..... 211/41; 211/181; 312/311; 312/312; 220/488

[58] Field of Search ..... 211/41, 181, 151; 312/311, 312; 220/488, 531

[56] References Cited

U.S. PATENT DOCUMENTS

| | | | |
|---|---|---|---|
| 3,752,322 | 8/1973 | Fiocca et al. | 211/41 |
| 4,046,261 | 9/1977 | Yake | 211/41 |
| 4,606,464 | 8/1986 | Jordan et al. | 211/41 |
| 4,917,248 | 4/1990 | Friskney | 211/41 |
| 5,158,185 | 10/1992 | Michael et al. | 211/41 |
| 5,205,419 | 4/1993 | Purtilo | 211/41 |
| 5,351,837 | 10/1995 | Smith | 211/41 |
| 5,480,035 | 1/1996 | Smith | 211/41 |

*Primary Examiner*—Robert W. Gibson, Jr.
*Attorney, Agent, or Firm*—Pearne, Gordon, McCoy & Granger

[57] ABSTRACT

At least one comb-like divider (5) that is movable between an erect position and a lowered position is pivotably mounted on the basket. A pivot member (6) of the divider is pivoted in an elongate hole of at least one support member (8) which is fixed to the basket. At least one shaped projection (10) of the pivot member (6) is capable of slidably co-operating with a cam profile (14) of the member (8). The cam profile terminates upwardly with a recess (15) that is aligned with the elongate hole (9) and receives the shaped projection (10) when the movable divider (5) is in the erect position. The shaped projection (10) is disengageable from the recess (15) with a lifting movement of the pivot member (6) along the elongate hole (9) in such a way as to permit the movable divider (5) to rotate towards the lowered position.

9 Claims, 2 Drawing Sheets

BASKET WITH A MOVABLE DIVIDER FOR A DISHWASHER

BACKGROUND OF THE INVENTION

The present invention relates generally to a basket for a dishwasher, and in particular to a basket of a type having at least one shaped, comb-like divider that is pivotably mounted so as to be movable between an erect position and a lowered position, for adapting the basket to the number and/or type of articles to be loaded into the basket.

Many baskets for dishwashers of such a type are known. These are generally made of metal wire with one or more comb-like dividers that are pivotably mounted to the base or to the sides of the basket. As described in U.S. Pat. Nos. 4,606,464 and 5,205,419 for example, the movable dividers are associated with hinges and flexible elements having a snap-engagement action for selectively locking the dividers in position. Such constructions are undesirably complicated and are undesirably liable to wear, abrasion, and breakage of the flexible snap-engagement elements. In addition, the movable dividers and the associated engagement elements are constrained to undesirably precise dimensional tolerances, which make manufacture and assembly thereof a laborious procedure.

Constructions are also known, for example from U.S. Pat. No. 4,917,248, in which shaped hinges with support grooves are capable of selectively locking the movable dividers in an erect or a lowered position, without the need for providing snap-engagement elements. In order to displace a movable divider from the erect position to the lowered position, it is necessary to effect an axial disengagement movement and then a rotary movement. That means that, when a movable divider is in an erect position for supporting for example plates, accidental axial displacement of the divider can cause it to fall, so that the plates consequently fall. Thus, such a construction can be improved.

SUMMARY OF THE INVENTION

The aim of the present invention is to provide a dishwasher basket having at least one movable divider that is simple, reliable and convenient to use.

According to the present invention, there is provided a dishwasher basket including a frame structure on which is pivotably mounted at least one comb-like divider. The divider has a pivot member from which extends a plurality of teeth. The divider is selectively movable between an erect position and a lowered position. Said pivot member is slidably pivotable in an elongate hole of at least one support member fixed to the frame structure. At least one shaped projection of the pivot member is capable of co-operating slidably with a cam profile of said support member. The cam profile terminates upwardly with a recess that is substantially aligned with the major axis of the elongate hole, and the hole is capable of receiving said shaped projection when the movable divider is in said erect position. The shaped projection is disengageable from said recess with a lifting movement of the pivot member along said elongate hole in such a way as to permit the movable divider to rotate towards said lowered position.

BRIEF DESCRIPTION OF THE DRAWINGS

The features and advantages of the invention will be clear from the following description given solely by way of non-limiting example with reference to the accompanying drawings in which.

DETAILED DESCRIPTION OF THE PREFERRED EMBODIMENTS

Figure 1:
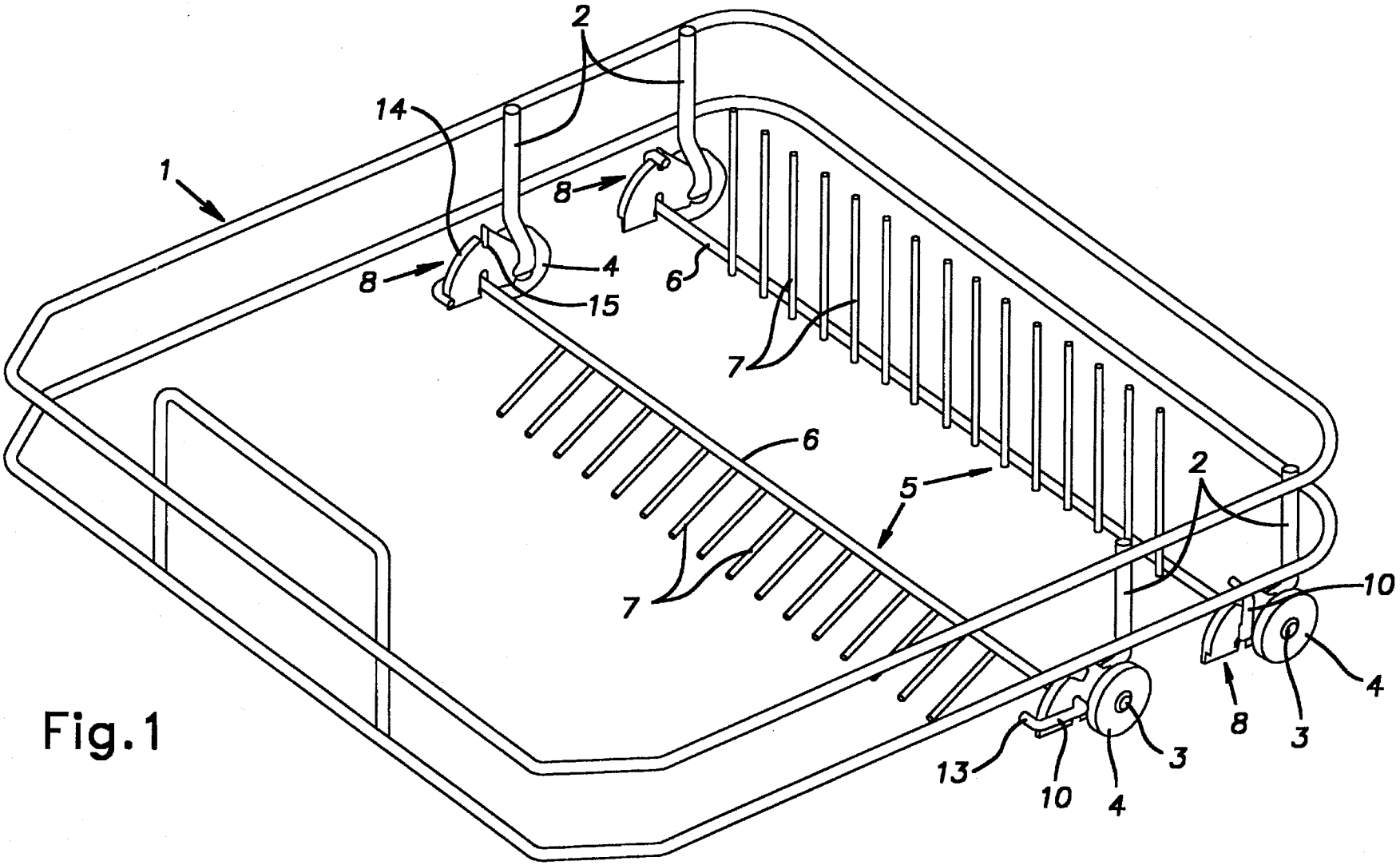
FIG. 1 is a perspective view of a basket for a dishwasher in accordance with a preferred embodiment (for the sake of clarity, only the main components of the basket are shown)

Referring to the drawings, the basket is formed of a frame structure which is preferably, but not necessarily, made of plastic-coated, round-section, metal rod. The frame generally includes a lateral peripheral surface of a side wall 1 and a bottom wall (not shown for the sake of simplicity) which is made in the form of a shaped grille for supporting a plurality of items in a known manner. Both the side wall 1 and bottom wall are open except for the rods defining them. Fixed to the side wall 1 are vertical uprights 2 which are shaped for example as described in Italian Utility Model Application No. PN93 U 000027. The vertical uprights 2 support a plurality of hollow hubs 3 on which respective rollers 4 are freely rotatably mounted. In a conventional manner, the rollers 4 are capable of co-operating with lateral guides (not shown) that are provided in the washing compartment of a dishwasher in such a way that the basket can be pulled out by a sliding movement.

The basket includes at least one movable, comb-like divider 5 with a horizontal, pivotable pivot member 6 from which extends a plurality of teeth 7. In a known manner, the teeth 7 are capable of supporting items when the divider 5 is in the erect position (at the right in FIG. 1) and do not interfere with loading the basket with bulky items when the divider 5 is in the lowered position (at the left in FIG. 1).

For selectively positioning the dividers 5 in the above-mentioned erect and lowered positions, each divider 5 is pivotably mounted on at least one support member 8, which is described in detail below and which can be made of plastic material. Preferably each divider 5 is pivotably mounted on two oppositely disposed support members 8, as. shown in FIG. 1.

The opposite ends of each pivot member 6 are slidable and pivotable in an elongate hole 9 in a respective member 8. Ends of the pivot member extend through the hole 9 and, on the outside of the member 8, define a substantially C-shaped projection 10.

Figure 2:
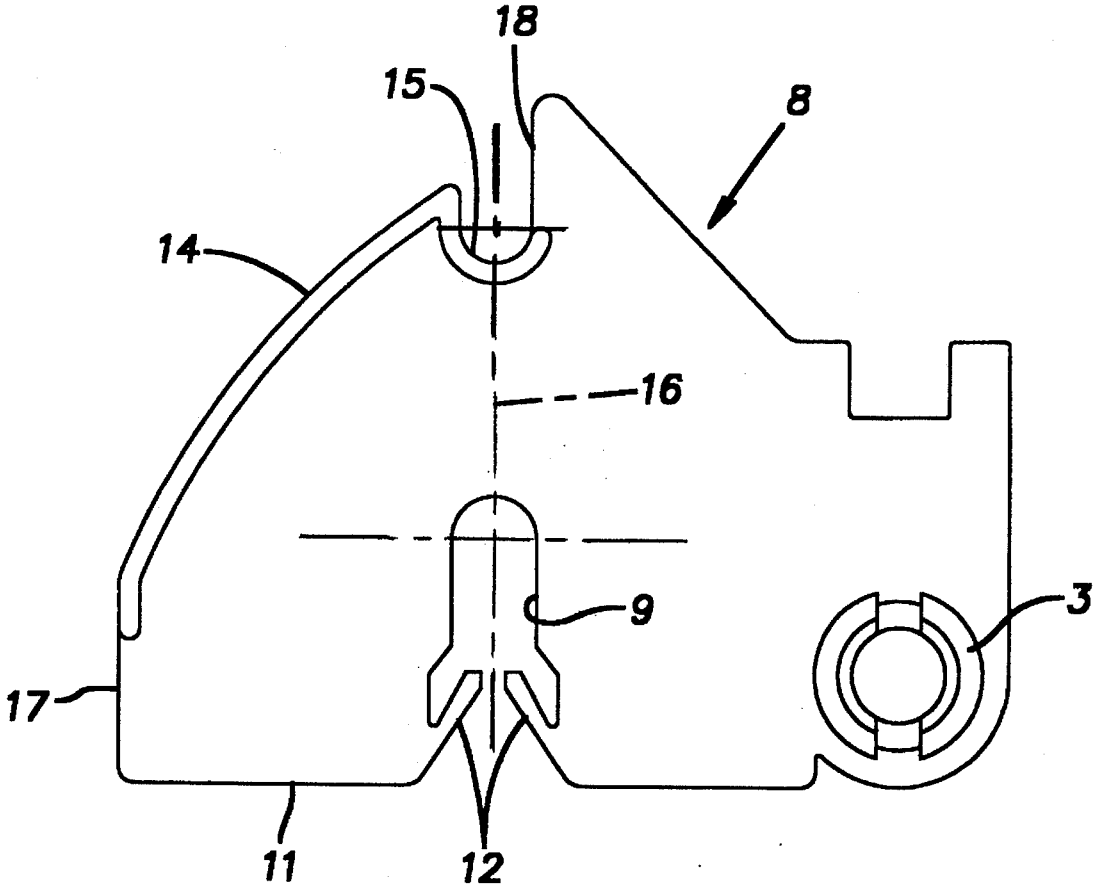
FIG. 2 is an enlarged view of a component of the basket shown in FIG. 1.

As is clear from FIG. 2, the elongate hole 9 is preferably formed by a recess provided on a lower surface 11 of the member 8. In association with the recess, a pair of flexible teeth 12 permit latching insertion of the pivot member 6 in the hole 9, thereby preventing accidental disengagement thereof. It will be appreciated that a single flexible tooth 12 may be used.

An end 13 of the "C" shaped projection 10 of the pivot member 6 is adapted for co-operating slidably with a cam profile 14 provided on an upper surface of the support member 8. An upper end of the cam profile 14 is connected to a locking recess 15 that is substantially aligned with the major axis 16 of the elongate hole 9, which is preferably vertical. In addition, provided at opposite ends of the cam profile 14 are respective end-of-travel stops 17 and 18 for the above-mentioned projection end 13.

When the divider 5 is in the erect position, the end 13 of the pivot member 6 is engaged by gravity in the recess 15 in the support member 8 while the pivot member 6 is in a bottom position in the elongate hole 9. Accidental falling of the divider 5 is therefore prevented by the weight of the divider, which holds the end 13 in engagement with the locking recess 15.

In order to move the divider 5 into the lowered position, the divider 5 is rotated after having raised it slightly in such a way as to disengage the end 13 thereof from the recess 15. That lifting movement is permitted by the elongate shape of the hole 9, along the axis 16 of which the pivot member 6 can freely slide. The divider 5 can then continue to rotate under the force of gravity (in the counter-clockwise direction in the drawings) with the end 13 which follows the cam profile 14 until the end bears against the lower end-of-travel stop 17 of the member 8.

In order to move the divider 5 back into the erect position again, it is rotated in the opposite direction (in the clockwise direction in the drawings). Due to the force of gravity, the end 13 of the pivot member 6 engages with the cam profile 14 of the member 8 and finally, bearing against the upper end-of-travel stop 18, passes into the recess 15 in which it remains locked as stated hereinbefore.

As will be apparent, positioning of the movable dividers 5 can be effected in a particularly simple and convenient manner with gentle, smooth movements which are substantially devoid of jamming and sticking phenomena. In addition, axial displacement of the pivot members 6 permitted by dimensional tolerances between the components has no adverse influence on the above-mentioned movements of the movable dividers, nor does such displacement adversely affect the stability thereof in the two operating positions that can be selected.

Preferably, a respective hollow hub 3 is integrally provided on each support member 8, each of which hubs can be fitted on to the end of a respective upright of the basket substantially as described for example in above-mentioned Italian Utility Model Application No. PN93 U 000027. The support members 8 can therefore be easily mounted on the basket, in turn supporting the movable dividers 5.

It will be appreciated that the basket for a dishwasher as described may be the subject of many modifications which fall within the scope of the invention.

For example, the basket may be made of molded plastic material or the movable dividers may be disposed in different positions on the basket itself.

What is claimed is:

1. A dishwasher basket comprising a frame structure; at least one comb-like divider pivotably mounted on the frame, said divider including a pivot member and a plurality of teeth extending from the pivot member, the divider being selectively movable between an erect position and a lowered position; at least one support member fixed to the frame structure and having an elongate hole and a cam profile terminating upwardly with a recess that is substantially aligned with a major axis of the elongate hole, said pivot member being slidable and pivotable in the elongate hole; and at least one shaped projection of the pivot member adapted for slidably co-operating with the cam profile, said recess being adapted for receiving said shaped projection when the movable divider is in said erect position, the shaped projection being disengageable from said recess with an upward movement of the pivot member in said elongate hole in such a way as to permit the movable divider to rotate towards said lowered position.

2. A dishwasher basket according to claim 1, wherein said elongate hole is formed by a lower recess provided on a lower surface of the support member; and further comprising at least one flexible tooth provided at the lower recess for permitting snap-engagement of the pivot member in the elongate hole.

3. A dishwasher basket according to claim 1 or 2, wherein respective end-of-travel stops are provided on the support member at opposite ends of said cam profile for defining said lowered and erect positions, respectively, of the movable divider.

4. A dishwasher basket according to claims 1 or 2, wherein the basket comprises lateral rollers rotatably mounted on respective hollow hubs supported by said frame structure, said hollow hubs being provided integrally on respective support members.

5. A dishwasher basket according to claim 3, wherein the basket comprises lateral rollers rotatably mounted on respective hollow hubs supported by said frame structure, said hollow hubs being provided integrally on respective support members.

6. A dishwasher incorporating a basket according to claims 1 or 2.

7. A dishwasher incorporating a basket according to claim 3.

8. A dishwasher incorporating a basket according to claim 4.

9. A dishwasher incorporating a basket according to claim 5.

* * * * *